73-649

SR

XR 4,035,165 [redacted]

United States Patent [19]

Archer

[11] 4,035,165

[45] July 12, 1977

[54] RAPPER MONITOR

[75] Inventor: William E. Archer, Huntington Beach, Calif.

[73] Assignee: Wahlco, Inc., Santa Ana, Calif.

[21] Appl. No.: 511,194

[22] Filed: Oct. 2, 1974

[51] Int. Cl.[2] ..... B03C 3/76

[52] U.S. Cl. ..... 55/13; 55/104; 55/112; 55/274; 55/300; 73/67; 340/239 F

[58] Field of Search ..... 55/104, 112, 138, 139, 55/300, 13, 274, 96; 340/239 F, 261; 73/67, 71.4

[56] References Cited

U.S. PATENT DOCUMENTS

| | | | |
|---|---|---|---|
| 3,235,826 | 2/1966 | Crites | 340/261 X |
| 3,267,725 | 8/1966 | Connaught | 340/261 X |
| 3,391,571 | 7/1968 | Johanson | 73/67 |
| 3,416,630 | 12/1968 | Pohl et al. | 73/71.4 X |
| 3,455,149 | 7/1969 | Foster et al. | 340/261 X |
| 3,487,606 | 1/1970 | Bridges et al. | 55/112 X |
| 3,570,628 | 3/1971 | Rodgers | 55/112 X |
| 3,577,705 | 5/1971 | Sharlit | 55/139 X |
| 3,606,733 | 9/1971 | Arstikaitis | 55/139 X |
| 3,641,539 | 2/1972 | Lesher | 340/261 X |
| 3,750,127 | 7/1973 | Ayers et al. | 340/261 |
| 3,754,379 | 8/1973 | Bridges et al. | 55/112 X |
| 3,893,828 | 7/1975 | Archer | 55/104 |

FOREIGN PATENT DOCUMENTS

| | | | |
|---|---|---|---|
| 1,089,516 | 11/1967 | United Kingdom | 340/239 F |

*Primary Examiner*—Frank W. Lutter
*Assistant Examiner*—Kathleen J. Prunner

[57] ABSTRACT

An apparatus and method for monitoring electrode rapper operation in an electrostatic precipitator. The actual movement or impact of the hammer in an electrode rapper is sensed and a control signal is generated and transmitted to a monitor in response thereto in order to produce an immediate and accurate indication of rapper failure.

8 Claims, 3 Drawing Figures

RAPPER MONITOR

In the art of gas cleansing it has long been well known practice to provide electrostatic precipitators for purging particulate contaminants such as dust or fly ash from dirty gases. Such devices have generally enjoyed wide acceptance in applicable industrial gas cleansing operations owing to their efficient, reliable and comparatively inexpensive mode of operation.

It is well known that conventional electrostatic precipitators generally must be provided with means for periodically removing particulates from collector surfaces to maintain precipitator reliability and efficiency. Commonly, mechanical rapping devices have been employed for this function whereby mechanical striking of the collector electrodes by such rappers imparts mechanical vibration thereto of sufficient magnitude to dislodge accumulated particulate deposits.

Although conventional rappers have generally been quite reliable, they have nonetheless commonly been equipped with means to monitor rapper operation in order to ensure proper rapper functioning inasmuch as rapper failure could result in excessive particulate accumulations on collector surfaces and consequent serious degradation of precipitator collecting efficiency. Such degradation is generally considered intolerable, particularly in view of the recent advent of strict statutory emission regulations.

Although heretofore known rapper monitors have generally served the purposes intended, they have been subject to certain undesirable deficiencies. For example, one prior rapper monitor comprises electronic means adapted to detect the presence of rapper operating impetus such as electrical current or fluid pressure at the rapper, and to initiate an alarm in the absence of such impetus. This monitoring scheme has been found wanting inasmuch as it fails to account for the possibility of mechanical sticking or jamming of the rapper such as might be caused by particulate accumulations, corrosion and the like.

Another prior approach to rapper monitoring has been to use conventional precipitator power supply monitors and alarms, which commonly are adapted to detect seriously degraded precipitator performance, to indicate rapper malfunction. This approach too is inadequate inasmuch as unacceptable quantities of particulates may be emitted to the atmosphere during gradually degraded precipitator operation before power supply alarms are initiated and in any case such an alarm may indicate any of numerous problems in addition to rapper malfunction. Additionally, reactivation of malfunctioning rappers at this point would require time consuming and inefficient procedures such as complete precipitator shutdown to avoid undesirable dust puffing.

These and other deficiencies of prior rapper monitoring methods are overcome by the present invention which comprises means to detect physical operation of the rapper whereby rapper malfunction is detected immediately upon the occurrence thereof regardless of the cause of the malfunction. The present invention provides fail safe and unambiguous rapper monitoring capability, and ensures that precipitator efficiency will not be degraded as a result of undetected rapper malfunction.

These and other objects and advantages of this invention are more fully specified in the following description and illustrations in which.

Figure 1:
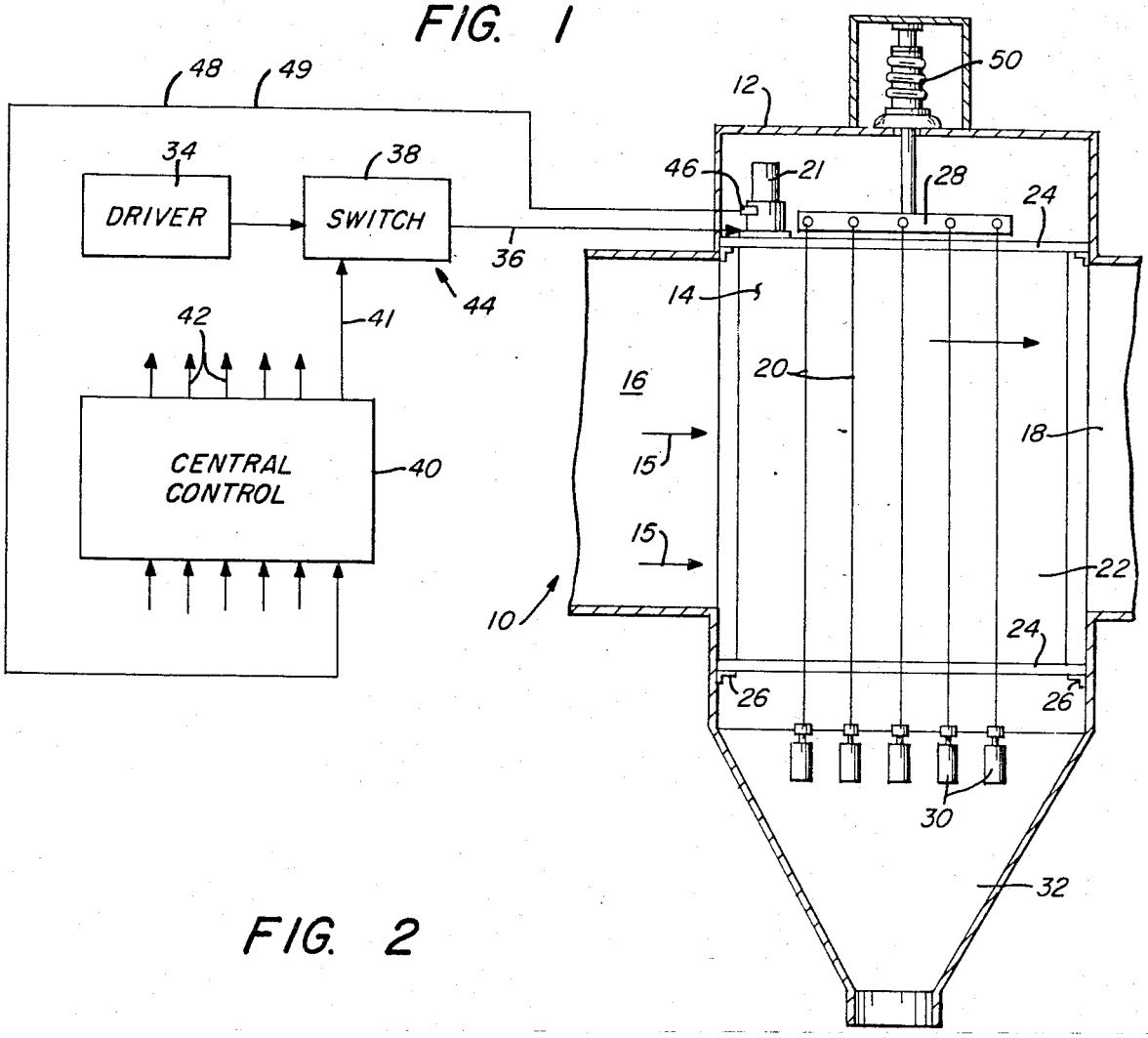
FIG. 1 illustrates in schematic an electrostatic precipitator including rappers monitored in accord with the principles of the present invention.

There is generally indicated at 10 in FIG. 1 an electrostatic precipitating apparatus including rappers 21 which are monitored in accord with the principles of the present invention. Those versed in the art will recognize that precipitator 10 may take any of various conventional and well known forms; however, for purposes of illustration the recitation hereinbelow is directed to a simplified precipitator adapted to the purposes of this invention. Of course it is to be understood from the outset that such simplification is not intended to unduly limit the scope of the invention described.

Accordingly, precipitator 10 as shown comprises a generally rectangular housing 12 which encloses a space 14 wherein is disposed a plurality of elongated, vertically extending discharge electrode wires 20 and a cooperable plurality of vertically extending plate-like collector electrodes 22. The respective electrodes 20 and 22 are positioned within space 14 in any suitable arrangement such as being spaced laterally in alternating order across the space 14. An inlet flue 16 and an outlet flue 18 are located adjacent respective opposed side walls of housing 12 and communicate with space 14 to define a gas flow path extending horizontally therebetween through the space 14 and laterally intermediate respective electrodes 20 and 22 as indicated by arrows 15.

The electrodes 22 are affixed and supported in the position described in any suitable manner such as by rigid, horizontally extending elongated support memebers 24, such as steel bars, suitably rigidly affixed adjacent respective uppermost and lowermost portions of each electrode 22 and rigidly affixed to opposed side walls of housing 12 by any suitable means such as by welding respective opposed end portions thereof to angle brackets 26 rigidly carried by housing 12. The mountings and structure of electrodes 22 are sufficiently resilient to permit mechanical vibration of electrodes 22 in response to rapping thereof by the conventional rappers 21 shown as being rigidly carried within space 14 by the upper members 24. Of course, rappers 21 may be carried in any conventional manner; for example, in the prior art rappers have often been carried externally of the precipitator housing and have been adapted to rap the respective collector electrodes by means of well known rapper shafts communicating therebetween. It is to be understood that the principles of the present invention apply to this and various other rapper mounting or carrying schemes.

The electrode wires 20 are suspended in the customary fashion from a rigid electrode support frame 28 which is supported by and electrically insulated from the housing 12 in any suitble manner as by being suspended within space 14 from a well known compression insulator 50. A respective cooperable plurality of weights 30, one weight 30 carried adjacent the lowermost end of each electrode wire 20, maintains the respective wires 20 in vertical tension.

In common practice electrodes 22 are electrically connected to housing 12 which is at ground potential, and electrodes 20 are electrically isolated from housing 12 as by the insulator 50 such that a high electrical potential from any suitable source (not shown) may be directed to wires 20 as by suitable conductors (also not shown) electrically connected to frame 28. The resultant potential difference between electrodes 20 and 22, and the particular arrangement thereof within space 14, promotes corona discharge in the space 14 intermediate the electrodes 20 and 22. As is well known, such corona discharge creates a zone of unipolar gas ions in the gas flow passing through space 14 from inlet 16 to outlet 18. The gas ions charge entrained particulates to the same polarity as the discharge electrode 20 and the charged particulates are thence driven by the intense electrostatic field extant intermediate discharge and collector electrodes to the oppositely charged collector electrodes 22 and are captured thereby as the gas flow continues through the space 14 and to outlet flue 18.

Inasmuch as the general structure and theory of operation of conventional electrostatic precipitators such as the precipitator 10 are well known to those versed in the art, further detailed description thereof is omitted herefrom. Suffice it to additionally note that accumulation of arrested particulates upon collectors 22 in the course of precipitator operation tends to gradually degrade precipitator operating efficiency. Therefore, the rappers 21 have been provided to periodically rap the collectors 22 to dislodge particulate accumulations therefrom. Such dislodged particulates subsequently fall perforce into a hopper or sump portion 32 of precipitator 10.

It is to be understood that the precipitator 10 may commonly include a plurality of the collectors 22, each of which may carry one or more of the rappers 21, and the frame 28 may also be provided with one or more rappers 21 for dislodging of spurious dust accumulations from the wires 20.

In practice, each of the rappers 21 is operatively connected to a suitable operating circuit generally indicated at 44 in FIG. 1 and shown schematically as comprising a driving means 34, for example a source of compressed air, which communicates with the respective rappers 21 via a suitable air conduit 36 including control means 38, for example a solenoid valve whereby actuation of the valve 38 provides compressed air from means 34 to rapper 21 to operate the rapper 21 in a manner to be described hereinbelow. The valve 38 communicates with and is controlled by a central control unit 40 as indicated by line 41. Unit 40 of course may be either fully automated or manually operable, and will include all suitable operating, time sequencing, alarm and other circuits in addition to suitable control panels and displays commonly required in the control of a conventional precipitator. As shown by arrows 42 the unit 40 may communicate cooperably with a plurality of valves 38 to control actuating air for a corresponding plurality of rappers 21.

Each circuit 44 additionally includes a monitoring portion 49 comprising sensing means 46 shown as being carried adjacent rapper 21 and adapted by means of a suitable connection 48 to provide a signal to control unit 40 in response to positive rapper operation whereby rapper operation may be monitored independently of other rapper control functions. In practice, the sensor 46 may be any suitable sensor capable of detecting the physical movement of the rapper or the physical impact of the rapping operation.

Figure 2:
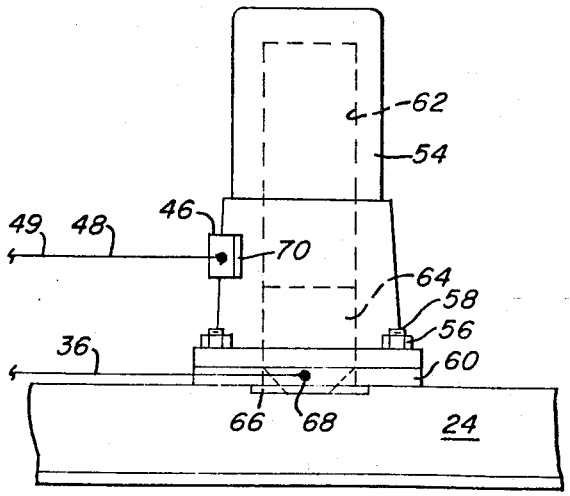
FIG. 2 is an enlarged fragmentary portion of FIG. 1 illustrating a rapper which is monitored in accord with one embodiment of the present invention.

The rappers 21 may take any of various conventional forms. However, for purposes of illustration a rapper 21 as shown in FIG. 2 includes a generally cylindrical housing 54 which is rigidly affixed adjacent an upper surface of member 24 as by threaded nuts 56 affixed to studs 58 which pass through a lower flanged portion 60 of housing 54. A coaxial bore 62 within housing 54 slideably carries therewithin a cylindrical hammer piston element 64 which is adapted to impact an anvil portion 66 of member 24 adjacent the lowermost end of the bore 62 upon actuation thereof by circuit 44. In practice, actuation of valve 38 admits pressurized air from compressor 34 into bore 62 below hammer 64 via conduit 36 and a port 68 to lift the hammer 64 from its lowermost position upwardly adjacent anvil 66 to an upper position spaced upwardly from anvil 66 within bore 62. Upon abrupt release of such air pressure as through an exhaust port or vent valve (not shown) the hammer 64 falls perforce within bore 62 to impact upon anvil 66 and mechanically vibrate the collector 22 carried by the respective member 24.

As shown in FIG. 2 rapper operation is sensed by means 46 which comprises a microphonic sensor 70 carried by housing 54 adjacent a lower end portion thereof and communicating by means of the line 48 with the control unit 40 to provide a signal indicating proper rapper operation in response to the sound emanating from the impact of hammer 64 upon anvil 66, which sound is transmitted without substantial dissipation or muting thereof through the material of housing 54. Thus, according to this embodiment of the invention the monitoring of rapper operation comprises sensing the actual physical operation of the rapper 21 rather than mere presence of a rapper actuating signal or other parameters not necessarily indicative of proper rapper functioning.

Figure 3:
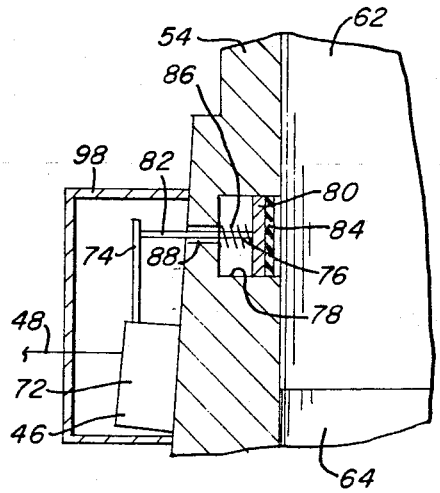
FIG. 3 is a central section of an enlarged fragmentary portion of FIG. 2 illustrating an alternative embodiment of the present invention.

According to FIG. 3 there is shown one alternative embodiment of the present invention wherein sensing means 46 comprises a known micro switch 72 carried within a protective shell 98 adjacent an exterior portion of housing 54 and having an actuator arm portion 74 which is operable by means of a pressure responsive piston assembly 76 reciprocably carried within a stepped transverse bore 78 located in the wall of housing 54 upwardly adjacent the lowermost position of hammer 64. The assembly 76 comprises: a piston 80 slideably disposed within the inner end portion of bore 78 adjacent bore 62; a rod portion 82 rigidly affixed to the piston 80 and extending coaxially outwardly therefrom through a reduced diameter outer portion 88 of the bore 78 to operatively engage the actuator 74; a flexible pressure responsive diaphragm 84 extending across bore 78 intermediate piston 80 and the intersection of bore 78 with bore 62; and a helical spring element 86 captively retained coaxially intermediate piston 80 and bore portion 88 to provide an inward bias to urge piston 80 toward a neutral position adjacent the diaphragm.

In practice, actuation of the hammer 64 through a rapper operating cycle as described hereinabove will result in varying air pressure being operable upon the diaphragm 84 from within bore 62 as hammer 64 in its reciprocable travel alternately exposes diaphragm 84 to a low pressure and a high pressure condition. In response thereto assembly 76 moves reciprocably inwardly and outwardly to actuate arm 74 of switch 72 thereby alternately opening and closing the monitoring circuit 49 to provide a signal indicative of rapper operation. Of course, assembly 76 may in practice be adapted to actuate other suitable sensors not shown here, for example a micro potentiometer. In this as in the first described embodiment of the present invention, actual rapper movement or operation is required to actuate the monitoring circuit 49.

As indicated hereinabove, the method of the present invention requires means for sensing actual movement of the rapper hammer 64. Accordingly, any sensor suitably adapted to sense such movement or the resultant forces, stresses, deflections, sounds and the like, may be employed. For example, in addition to the sensors described hereinabove, the scope of the present invention in intended to include but is not limited to such various sensors as: a resistance strain gauge carried by member 24 adjacent anvil 66; an inertial accelerometer carried by housing 54 adjacent anvil 66; a piezoelectric element; a magnetostrictive element; sophisticated means such as X-ray or laser techniques; and the like. Thus, according to the foregoing recitation there is provided by this invention a method of monitoring rapper operation whereby the actual physical operation or movement of the rapper is detected. Accordingly, by virtue of this invention rapper operation may be monitored independently of precipitator power supply monitors, rapper operating signal monitors or other means not necessarily indicative of proper rapper operation.

Notwithstanding the reference hereinabove to certain preferred embodiments of the present invention it will be understood that this invention is susceptible of numerous alternative embodiments and modifications thereto without departing from the broad spirit and scope thereof. For example: rappers 21 may be electromagnetically actuated rappers or any of various other known types; the control unit 40 may include various ancillary circuits for such purposes as sequencing of rapper operation or adjustment of the frequency of rapper operation in response to the total dust load or gas flow passing through the precipitator housing 54 may be variously configures within a wide design latitude; and the like.

These and other embodiments and modifications having been envisioned and anticipated it is requested that this invention be interpreted broadly and limited only by the scope of the claims appended hereto.

What is claimed is:

1. In an electrostatic precipitator having an electrode assembly and a rapping means for dislodging dust accumulations from said electrode assembly, said rapping means including a hammer movable through operating cycles for periodically delivering an impact blow to said electrode assembly, the improvement comprising: detecting means operatively associated with said rapping means for sensing hammer movement through said operating cycles and for generating control signals in response thereto; and monitoring means operatively associated with said detecting means for indicating, in response to the discontinuance of said control signals, the failure of said hammer to move through said oerating cycles.

2. The improvement as set forth in claim 1 wherein: said hammer is reciprocable within a chamber and reciprocation of said hammer creates an alternating high and low pressure condition within said chamber; and said detecting means includes a diaphragm exposed to said pressure conditions to cause movement of said diaphragm, and includes switch means operatively associated with and connected between said diaphragm and said monitoring means and adapted to alternately open and close in response to said diaphragm movement and thus provide said control signals.

3. The improvement as set forth in claim 1 including a gas flow path defined within said precipitator, said detecting means disposed exteriorly of said gas flow path.

4. In an electrostatic precipitator having an electrode assembly and a rapping means for dislodging dust accumulations from said electrode assembly, said rapping means including a hammer movable through operating cycles for periodically delivering an impact blow to said electrode assembly, the improvement comprising: detecting means operatively associated with said rapping means for sensing the periodic impact blow of said hammer on said electrode assembly and for gererating control signals in response to said period impacting; monitoring means operatively associated with said detecting means for indicating, in response to the discontinuance of said contol signals, the failure of said hammer to impact on said electrode assembly.

5. The improvement as set forth in claim 4 including a gas flow path defined within said precipitator, said detecting means being disposed exteriorly of said gas flow path.

6. A method of monitoring rapper operation in an electrostatic precipitator having an electrode assembly and a rapping means for dislodging dust accumulation from said electrode assembly, said rapping means including a movable hammer, comprising the steps of: sensing the actual operation of said hammer, gererating control signals in response to said sensing; and monitoring said control signals to determine whether said hammer is operating.

7. The method specified in claim 6 wherein said sensing said actual operation is effected by sensing sound waves generated when said hammer impacts on said electrode assembly.

8. The method specified in claim 6 wherein said sensing said actual operation is effected by sensing pressure waves generated as said hammer reciprocates within a chamber.

* * * * *